US010119726B2

(12) United States Patent
Smith et al.

(10) Patent No.: US 10,119,726 B2
(45) Date of Patent: Nov. 6, 2018

(54) WATER HEATER STATUS MONITORING SYSTEM

(71) Applicant: Honeywell International Inc., Morris Plains, NJ (US)

(72) Inventors: Timothy J. Smith, Minneapolis, MN (US); John D. Mitchell, Maple Grove, MN (US); Adam Myre, Minnetonka, MN (US)

(73) Assignee: Honeywell International Inc., Morris Plains, NJ (US)

( * ) Notice: Subject to any disclaimer, the term of this patent is extended or adjusted under 35 U.S.C. 154(b) by 0 days.

(21) Appl. No.: 15/287,486

(22) Filed: Oct. 6, 2016

(65) Prior Publication Data

US 2018/0100672 A1 Apr. 12, 2018

(51) Int. Cl.
*F24H 9/20* (2006.01)
*F24H 1/18* (2006.01)

(52) U.S. Cl.
CPC ..... *F24H 9/2035* (2013.01); *F24H 1/186* (2013.01)

(58) Field of Classification Search
CPC ..... F23N 5/242; F23N 1/002; F23N 5/102; F23N 2041/04; Y10T 137/1407; Y10T 137/1516
See application file for complete search history.

(56) References Cited

U.S. PATENT DOCUMENTS 2,331,718 A 10/1943 Newton
2,920,126 A 1/1960 Hajny
3,272,432 A 9/1966 Davidson
3,759,279 A 9/1973 Smith, Jr.
3,833,428 A 9/1974 Snyder et al.
3,847,350 A 11/1974 Thompson
3,849,350 A 11/1974 Matsko
(Continued)

FOREIGN PATENT DOCUMENTS

CA 2158120 A1 3/1997
CN 201772614 U 3/2011
(Continued)

OTHER PUBLICATIONS

International Search Report and Written Opinion for PCT Application No. PCT/US2017/055446, dated Jan. 4, 2018.
(Continued)

*Primary Examiner* — Gregory A Wilson
(74) *Attorney, Agent, or Firm* — Seager Tufte & Wickhem LLP

(57) ABSTRACT

A water heater having a monitoring mechanism, an appliance burner configured to heat water in a tank of a water heater, a water temperature sensor configured to detect a water temperature in the tank, a pilot device configured to ignite the appliance burner, and a thermopile having a tip and a base, and having an output voltage that represents a temperature difference between the tip and the base. The tip of the thermopile may be heated by the pilot device. The base of the thermopile may receive heat from the appliance burner when the appliance burner is turned on, and thus the voltage output of the thermopile may decrease. If the voltage output does not decrease and the water temperature exceeds a thermal cutout limit, then a warning about the water heater may be issued by the monitoring mechanism.

18 Claims, 4 Drawing Sheets

(56) References Cited

U.S. PATENT DOCUMENTS 3,909,816 A 9/1975 Teeters
3,948,439 A 4/1976 Heeger
4,127,380 A 11/1978 Straitz, III
4,131,413 A 12/1978 Ryno
4,204,833 A 5/1980 Kmetz et al.
4,221,557 A 9/1980 Jalics
4,305,547 A 12/1981 Cohen
4,324,207 A 4/1982 Leuthard
4,324,944 A 4/1982 Weihrich et al.
RE30,936 E 5/1982 Kmetz et al.
4,333,002 A 6/1982 Kozak
4,421,062 A 12/1983 Pallida, Sr.
4,438,728 A 3/1984 Fracaro
4,467,178 A 8/1984 Swindle
4,483,672 A 11/1984 Wallace et al.
4,507,938 A 4/1985 Hama et al.
4,508,261 A 4/1985 Blank
4,511,790 A 4/1985 Kozak
4,568,821 A 2/1986 Boe
4,588,875 A 5/1986 Kozak et al.
4,638,789 A 1/1987 Ueki et al.
4,655,705 A 4/1987 Shute et al.
4,692,598 A 9/1987 Yoshida et al.
4,696,639 A 9/1987 Bohan, Jr.
4,734,658 A 3/1988 Bohan, Jr.
4,742,210 A 5/1988 Tsuchiyama et al.
4,770,629 A * 9/1988 Bohan, Jr. ..... F23N 5/102 431/42
4,778,378 A 10/1988 Dolnick et al.
4,830,601 A 5/1989 Dahlander et al.
4,834,284 A 5/1989 Vandermeyden
4,906,337 A 3/1990 Palmer
4,965,232 A 10/1990 Mauleon et al.
4,977,885 A 12/1990 Herweyer et al.
4,984,981 A 1/1991 Pottebaum
4,986,468 A 1/1991 Deisinger
5,007,156 A 4/1991 Hurtgen
5,037,291 A 8/1991 Clark
5,077,550 A 12/1991 Cormier
5,103,078 A 4/1992 Boykin et al.
5,112,217 A 5/1992 Ripka et al.
5,125,068 A 6/1992 McNair et al.
5,126,721 A 6/1992 Butcher et al.
5,222,888 A 6/1993 Jones et al.
5,232,582 A 8/1993 Takahashi et al.
5,236,328 A 8/1993 Tate et al.
5,280,802 A 1/1994 Comuzie, Jr.
5,312,036 A 5/1994 Trotter
5,317,670 A 5/1994 Elia
5,391,074 A 2/1995 Meeker
5,424,554 A 6/1995 Marran et al.
5,442,157 A 8/1995 Jackson
5,567,143 A 10/1996 Servidio
5,622,200 A 4/1997 Schulze
5,660,328 A 8/1997 Momber
5,779,143 A 7/1998 Michaud et al.
5,791,890 A 8/1998 Maughan
5,797,358 A 8/1998 Brandt et al.
5,857,845 A 1/1999 Paciorek
5,896,089 A 4/1999 Bowles
5,968,393 A 10/1999 Demaline
5,971,745 A 10/1999 Bassett et al.
5,975,884 A 11/1999 Dugger
6,053,130 A 4/2000 Shellenberger
6,059,195 A 5/2000 Adams et al.
6,069,998 A 5/2000 Barnes et al.
6,075,923 A 6/2000 Wu
6,080,971 A 6/2000 Seitz et al.
6,208,806 B1 3/2001 Langford
6,212,894 B1 4/2001 Brown et al.
6,236,321 B1 5/2001 Troost, IV
6,261,087 B1 7/2001 Bird et al.
6,271,505 B1 8/2001 Henderson
6,286,464 B1 9/2001 Abraham et al.
6,293,471 B1 9/2001 Stettin et al.
6,299,433 B1 10/2001 Gauba et al.
6,350,967 B1 2/2002 Scott
6,351,603 B2 2/2002 Waithe et al.
6,363,218 B1 3/2002 Lowenstein et al.
6,371,057 B1 4/2002 Henderson
6,375,087 B1 4/2002 Day et al.
6,390,029 B2 5/2002 Alphs
RE37,745 E 6/2002 Brandt et al.
6,410,842 B1 6/2002 McAlonan
6,455,820 B2 9/2002 Bradenbaugh
6,553,946 B1 4/2003 Abraham et al.
6,560,409 B2 5/2003 Troost, IV
6,606,968 B2 8/2003 Iwama et al.
6,629,021 B2 9/2003 Cline et al.
6,631,622 B1 10/2003 Ghent et al.
6,633,726 B2 10/2003 Bradenbaugh
6,684,821 B2 2/2004 Lannes et al.
6,701,874 B1 * 3/2004 Schultz ..... H01L 35/00 122/14.2
6,732,677 B2 5/2004 Donnelly et al.
6,794,771 B2 9/2004 Orloff
6,795,644 B2 9/2004 Bradenbaugh
6,835,307 B2 12/2004 Talbert et al.
6,845,110 B2 1/2005 Gibson
6,861,621 B2 3/2005 Ghent
6,880,493 B2 4/2005 Clifford
6,920,377 B2 7/2005 Chian
6,934,862 B2 8/2005 Sharood et al.
6,936,798 B2 8/2005 Moreno
6,955,301 B2 10/2005 Munsterhuis et al.
6,959,876 B2 11/2005 Chian et al.
6,967,565 B2 11/2005 Lingemann
6,973,819 B2 12/2005 Ruhland et al.
6,995,301 B1 2/2006 Shorrosh
7,032,542 B2 4/2006 Donnelly et al.
7,065,431 B2 6/2006 Patterson et al.
7,076,373 B1 7/2006 Munsterhuis et al.
7,088,238 B2 8/2006 Karaoguz et al.
7,103,272 B2 9/2006 Baxter
7,117,825 B2 10/2006 Phillips
7,137,373 B2 11/2006 Seymour, II et al.
7,162,150 B1 1/2007 Welch et al.
7,167,813 B2 1/2007 Chian et al.
7,221,862 B1 5/2007 Miller et al.
7,252,502 B2 * 8/2007 Munsterhuis ..... F23N 1/002 122/448.1
7,255,285 B2 8/2007 Troost et al.
7,298,968 B1 11/2007 Boros et al.
7,317,265 B2 1/2008 Chian et al.
7,346,274 B2 3/2008 Bradenbaugh
7,373,080 B2 5/2008 Baxter
7,380,522 B2 6/2008 Krell et al.
7,432,477 B2 10/2008 Teti
7,434,544 B2 10/2008 Donnelly et al.
7,469,550 B2 12/2008 Chapman, Jr. et al.
7,497,386 B2 * 3/2009 Donnelly ..... F23N 1/002 236/15 BG
7,506,617 B2 3/2009 Paine
7,526,539 B1 4/2009 Hsu
7,561,057 B2 7/2009 Kates
7,603,204 B2 10/2009 Patterson et al.
7,613,855 B2 11/2009 Phillips et al.
7,623,771 B2 11/2009 Lentz et al.
7,634,976 B2 12/2009 Gordon et al.
7,672,751 B2 3/2010 Patterson et al.
7,712,677 B1 5/2010 Munsterhuis et al.
7,744,007 B2 6/2010 Beagen et al.
7,744,008 B2 6/2010 Chapman, Jr. et al.
7,770,807 B2 8/2010 Robinson et al.
7,798,107 B2 9/2010 Chian et al.
7,804,047 B2 9/2010 Zak et al.
7,818,095 B2 10/2010 Hotton et al.
7,902,959 B2 3/2011 Yamada et al.
7,932,480 B2 4/2011 Gu et al.
7,934,662 B1 5/2011 Jenkins
7,970,494 B2 6/2011 Fima
7,974,527 B1 7/2011 Adler
8,061,308 B2 11/2011 Phillips
8,074,894 B2 12/2011 Beagen

(56) References Cited

U.S. PATENT DOCUMENTS

| | | | | |
|---|---|---|---|---|
| 8,083,104 | B2 | 12/2011 | Roetker et al. | |
| 8,111,980 | B2 | 2/2012 | Bradenbaugh | |
| 8,165,726 | B2 | 4/2012 | Nordberg et al. | |
| 8,204,633 | B2 | 6/2012 | Harbin, III et al. | |
| 8,245,987 | B2 | 8/2012 | Hazzard et al. | |
| 8,322,312 | B2 | 12/2012 | Strand | |
| 8,360,334 | B2 | 1/2013 | Nold et al. | |
| 8,367,984 | B2 | 2/2013 | Besore | |
| 8,422,870 | B2 | 4/2013 | Nelson et al. | |
| 8,485,138 | B2 | 7/2013 | Leeland | |
| 8,498,527 | B2 | 7/2013 | Roetker et al. | |
| 8,600,556 | B2 | 12/2013 | Nesler et al. | |
| 8,606,092 | B2 | 12/2013 | Amiran et al. | |
| 8,660,701 | B2 | 2/2014 | Phillips et al. | |
| 8,667,112 | B2 | 3/2014 | Roth et al. | |
| 8,726,789 | B2 | 5/2014 | Clark | |
| 8,770,152 | B2 | 7/2014 | Leeland et al. | |
| 9,080,769 | B2 | 7/2015 | Bronson et al. | |
| 9,122,283 | B2 | 9/2015 | Rylski et al. | |
| 9,195,242 | B2 | 11/2015 | Zobrist et al. | |
| 9,228,746 | B2 | 1/2016 | Hughes et al. | |
| 9,249,986 | B2 | 2/2016 | Hazzard et al. | |
| 9,268,342 | B2 | 2/2016 | Beyerle et al. | |
| 9,310,098 | B2 | 4/2016 | Buescher et al. | |
| 9,435,566 | B2 | 9/2016 | Hill et al. | |
| 9,797,600 | B2 * | 10/2017 | Barels | F23N 1/002 |
| 2002/0099474 | A1 | 7/2002 | Khesin | |
| 2003/0093186 | A1 | 5/2003 | Patterson et al. | |
| 2004/0042772 | A1 | 3/2004 | Whitford et al. | |
| 2004/0079749 | A1 | 4/2004 | Young et al. | |
| 2006/0027571 | A1 | 2/2006 | Miyoshi et al. | |
| 2006/0272830 | A1 | 12/2006 | Fima | |
| 2007/0023333 | A1 | 2/2007 | Mouhebaty et al. | |
| 2007/0210177 | A1 | 9/2007 | Karasek | |
| 2007/0292810 | A1 | 12/2007 | Maiello et al. | |
| 2008/0003530 | A1 | 1/2008 | Donnelly et al. | |
| 2008/0023564 | A1 | 1/2008 | Hall | |
| 2008/0048046 | A1 | 2/2008 | Wagner et al. | |
| 2008/0197206 | A1 | 8/2008 | Murakami et al. | |
| 2009/0117503 | A1 | 5/2009 | Cain | |
| 2009/0191495 | A1 * | 7/2009 | Guzorek | F23L 11/005 431/20 |
| 2010/0065764 | A1 | 3/2010 | Canpolat | |
| 2010/0163016 | A1 | 7/2010 | Pan | |
| 2011/0254661 | A1 | 10/2011 | Fawcett et al. | |
| 2011/0259322 | A1 | 10/2011 | Davis et al. | |
| 2011/0277706 | A1 * | 11/2011 | Arnold | F24H 1/205 122/14.1 |
| 2011/0305444 | A1 | 12/2011 | Pussell | |
| 2012/0060771 | A1 | 3/2012 | Brian et al. | |
| 2012/0060829 | A1 | 3/2012 | DuPlessis et al. | |
| 2012/0276488 | A1 | 11/2012 | Virag et al. | |
| 2013/0104814 | A1 | 5/2013 | Reyman | |
| 2014/0202549 | A1 | 7/2014 | Hazzard et al. | |
| 2014/0203093 | A1 | 7/2014 | Young et al. | |
| 2014/0212821 | A1 | 7/2014 | Banu et al. | |
| 2015/0083384 | A1 | 3/2015 | Lewis, Jr. et al. | |
| 2015/0120067 | A1 | 4/2015 | Wing et al. | |
| 2015/0276268 | A1 | 10/2015 | Hazzard et al. | |
| 2015/0277463 | A1 | 10/2015 | Hazzard et al. | |
| 2015/0354833 | A1 | 12/2015 | Kreutzman | |
| 2016/0260312 | A1 | 9/2016 | Hazzard et al. | |
| 2016/0305827 | A1 | 10/2016 | Heil et al. | |
| 2016/0342163 | A1 | 11/2016 | Hazzard et al. | |

FOREIGN PATENT DOCUMENTS

| | | | |
|---|---|---|---|
| CN | 201909441 | U | 7/2011 |
| CN | 102213489 | A | 10/2011 |
| CN | 203203717 | U | 9/2013 |
| EP | 0356609 | A1 | 3/1990 |
| EP | 0531072 | A1 | 3/1993 |
| EP | 0699316 | B1 | 7/1999 |
| EP | 0967440 | A2 | 12/1999 |
| EP | 1148298 | B1 | 10/2004 |
| EP | 1621814 | A2 | 2/2006 |
| EP | 1178748 | B1 | 10/2006 |
| EP | 2108140 | B1 | 6/2012 |
| FR | 2820206 | A1 | 8/2002 |
| GB | 2211331 | A | 6/1989 |
| JP | 08264469 | A | 10/1996 |
| JP | 2005283039 | A | 10/2005 |
| JP | 2006084322 | A | 3/2006 |
| JP | 2008008548 | A | 1/2008 |
| JP | 2011220560 | A | 4/2011 |
| TW | 1431223 | B | 3/2014 |
| WO | 9718417 | A1 | 5/1997 |
| WO | 2008102263 | A2 | 8/2008 |
| WO | 2009022226 | A2 | 2/2009 |
| WO | 2009061622 | A1 | 5/2009 |
| WO | 2011104592 | A1 | 9/2011 |

OTHER PUBLICATIONS

"Results and Methodology of the Engineering Analysis for Residential Water Heater Efficiency Standards," 101 pages, Oct. 1998.
AO Smith, "IComm Remote Monitoring System, Instruction Manual," 64 pages, Jun. 2009.
U.S. Appl. No. 14/964,392, filed Dec. 9, 2015.
Filibeli et al., "Embedded Web Server-Based Home Appliance Networks," Journal of Network and Computer Applications, vol. 30, pp. 499-514, 2007.
Halfbakery.com, "Hot Water Alarm," 2 pages, Sep. 4, 2002.
Heat Transfer Products Inc., "Specification for Heat Transfer Products, Inc., Vision 3 System," 2 pages, Mar. 17, 2006.
Hiller, "Dual-Tank Water Heating System Options," ASHRAE Transactions: Symposia, pp. 1028-1037, Downloaded Nov. 16, 2012.
Honeywell International Inc., "CS8800 General Assembly, Drawing No. 50000855," 2 pages, Oct. 24, 2008.
Honeywell International Inc., "Thermopile Assembly, Drawing No. 50006821," 1 page, Jun. 18, 2010.
Honeywell International Inc., "Thermopile Element, Drawing No. 50010166," 1 page, Apr. 1, 2005.
Honeywell International Inc., "Thermopile General Assembly, Drawing No. 50006914," 1 page, Jan. 12, 2006.
Honeywell International Inc., Photograph of a CS8800 Thermocouple Assembly, 1 page, saved Oct. 9, 2014.
http://nachi.org/forum/f22/dual-water-heater-installations-36034/, "Dual Water Heater Installation," 10 pages, printed Oct. 1, 2012.
http://www.whirlpoolwaterheaters.corn/learn_more/energysmartelectricwaterheateroperation.aspx, link no longer functions, "Energy Smart Electric Water Heater Operation," 3 pages, prior to Nov. 13, 2012.
http://www.whirlpoolwaterheaters.com/learn-more/eletric-water-heaters/6th-sense%E2% . . . , "Whirlpool Energy Smart Electric Water Heater, Learn More," 3 pages, printed Jan. 15, 2015.
Industrial Controls, "Basics of PID Control (Proportional+Integral+Derivative)," downloaded from https://web.archive.org/web/20110206195004/http://wwww.industrialcontrolsonline.com /training/online/basics-pid-control-proportionalintegralderivative, 4 pages, Feb. 6, 2011.
InspectAPedia, "Guide to Alternative Hot Water Sources," 6 pages, printed Oct. 1, 2012.
Johnson Controls, "K Series BASO Thermocouples, Heating Line Product Guide 435.0, Thermocouples Section, Product Bulletin K Series," 8 pages, Oct. 1998.
Lennox, "Network Control Panel, Users Manual," 18 pages, Nov. 1999.
Moog, "M3000 Control System, RTEMP 8, Remote 8-Channel Temperature Controller with CanOpen Interface," 6 pages, Nov. 2004.
Process Technology, "Troubleshooting Electric Immersion Heaters," downloaded from http://www.processtechnology.com/troubleshootheaters.html, 3 pages, Mar. 22, 2010.
Raychem, "HWAT-ECO," Tyco Thermal Control, 4 pages, 2012.

(56) References Cited

OTHER PUBLICATIONS

Reliance Water Heaters, "Service Handbook for Standard Residential FVIR Gas Water Heaters, Models: G/LORT, G/LORS, G/LBRT, G/LBRS/ G/LBCT, G/LBCS, G/LKRT, G/LKRS, G/LKCT, G/LKRT, G/LARS, G/LXRT, G/LQRT—Series 200/201 and Series 202/203," 44 pages, Nov. 2009.

Techno Mix, "Installation-Series and Parallel," downloaded from www.chinawinds. co.uk/diy_tips/installation_series_and_parallel.html, 5 pages, printed Oct. 1, 2012.

Triangle Tube, "Prestige Solo Condensing High Efficiency Gas Boiler," 4 pages, revised Apr. 30, 2012.

* cited by examiner

WATER HEATER STATUS MONITORING SYSTEM

BACKGROUND

The present disclosure pertains to water heater systems and to detection of system issues.

SUMMARY

The disclosure reveals a water heater having a monitoring mechanism, an appliance burner configured to heat water in a tank of a water heater, a water temperature sensor configured to detect a water temperature in the tank, a pilot device configured to ignite the appliance burner, and a thermopile having a tip and a base, and having an output voltage that represents a temperature difference between the tip and the base. The tip of the thermopile may be heated by the pilot device. The base of the thermopile may receive heat from the appliance burner when the appliance burner is turned on, and thus the voltage output of the thermopile may decrease. If the voltage output does not decrease and the water temperature exceeds a thermal cutout limit, then a warning about the water heater may be issued by the monitoring mechanism.

DESCRIPTION

Figure 1:
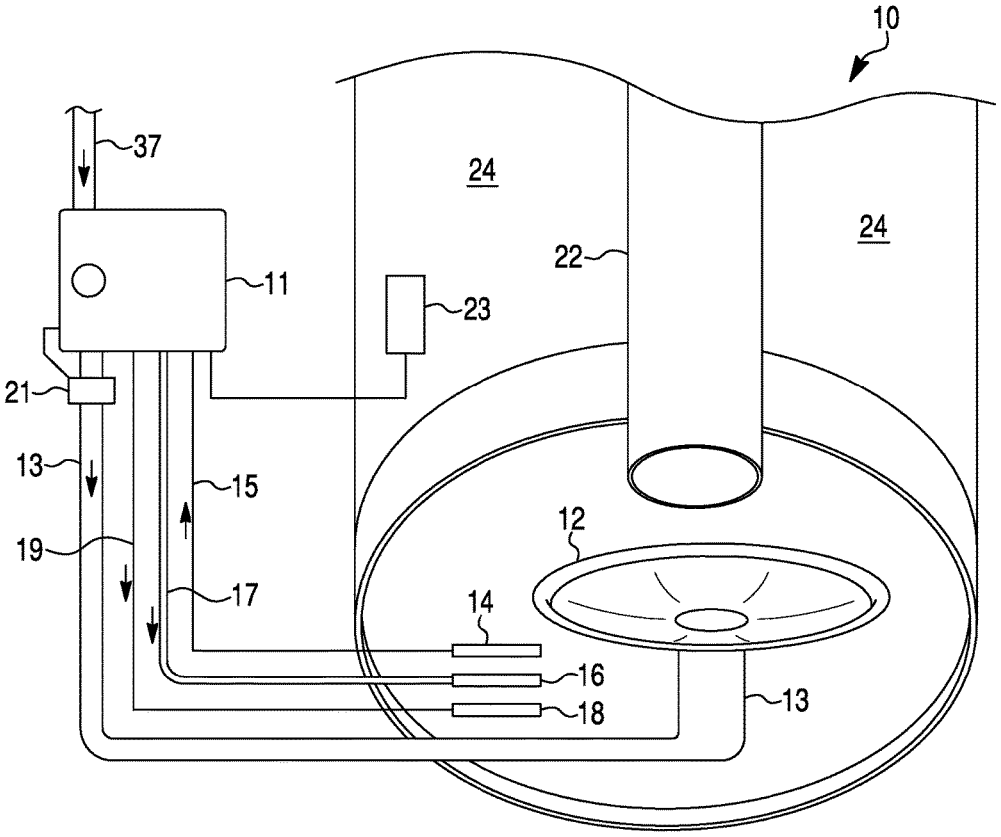
FIG. 1 is a diagram of a pilot light and appliance burner integration in a water heater system.

The present system and approach may incorporate one or more processors, computers, controllers, user interfaces, wireless and/or wire connections, and/or the like, in an implementation described and/or shown herein.

This description may provide one or more illustrative and specific examples or ways of implementing the present system and approach. There may be numerous other examples or ways of implementing the system and approach.

Aspects of the system or approach may be described in terms of symbols in the drawing. Symbols may have virtually any shape (e.g., a block) and may designate hardware, objects, components, activities, states, steps, procedures, and other items.

In fuel valves used on water heater applications, water temperature sensing may be a way to detect a stuck open valve, for example, a gas valve. If the water temperature inside the heater exceeds a temperature cut out (TCO) limit, a modular or control mechanism may take action and shut down power to the gas valve, causing the valve to seal shut and stop gas flow. Over time, in certain water heater applications, the water tank may become filled with sediment from water minerals and eroding anode rod material. As built-up sediment heats during a call for heat, portions of sediment may exceed the actual water temperature enough to trigger a TCO event and shut off the gas valve. Such a false failure may result in nuisance call-backs from service technicians. The present approach may eliminate the false failure by detecting a "truly" stuck open valve.

The present approach may use another output from a sensor to verify whether or not a runaway burner event is occurring that can create a TCO event. Technical benefits may include a more robust control mechanism that eliminates false failures which result in service calls to the end user. Additionally, the present approach may alert the end user of potential appliance maintenance required. If the module or control mechanism is regularly sensing false failures, the end user may be informed to flush sediment build up from the water heater. If the control mechanism senses truly excessive water temperature without the main burner firing, it may warn against potential scalding concerns. These alerts may be communicated via a control mechanism's LED, wirelessly to the end user or a service maintenance company, or a combination of the noted indications. Business advantages may incorporate providing a more robust control that has better field performance.

Additionally, there may be a potential for up-selling by creating more value to the end user, as well as eliminating false failures that could be looked upon as a controlling fault.

In a thermopile-powered gas valve, a tip of the thermopile may reside in the standing pilot flame. As the tip of the pilot heats up, a temperature difference may be created between the tip and a base of the thermopile. The temperature difference may create an electrical voltage necessary to power the gas valve. The greater the temperature difference, the greater the voltage. However, when a call for heat occurs and the main burner ignites, the temperature at the base of the thermopile may increase because of the heat generated by the main burner. Consequently, the temperature differential across the thermopile may decrease, causing a decrease in the thermopile output voltage. The decrease in the thermopile output voltage may be used as a secondary signal to take action to shut the gas valve down. To eliminate false failures, the water heater control mechanism may monitor the thermopile output voltage. If the water temperature is rising and exceeds the TCO limit, then the control mechanism may check the thermopile voltage. If the thermopile voltage has decreased compared to the voltage during a time when only the pilot is operating, this may indicate that the main burner is on and the control may shut down the burner. However, if the water temperature is rising and exceeds the TCO limit, but the thermopile voltage is not less than when the pilot is only on, then instead of shutting down, the control mechanism may lower the water temperature set point and enunciate a need for service through a status light indicator or wireless signal from the control mechanism.

The approach may have a software component with a stack level of a sensor that may be a hardware device, such as the control mechanism, having some software for detecting, measuring and transmitting data (e.g., temperature, pressure, motion). A software type may be embedded software that runs in a device or unit (e.g., firmware). There may be an IoT (Internet of Things) component associated with the control mechanism. For example, a water heater system may be monitored and diagnosed via the internet.

FIG. 1 is a diagram of a pilot light 16 and burner appliance heater or burner 12 integrated in a water heater system 10. A control module or mechanism 11 may be connected to a main or appliance burner or heater 12 via a fuel line 13. Control mechanism or module 11 may incorporate a microprocessor that controls a valve 21 that is in series with fuel line 13. There may be a pilot valve in control module or mechanism 11 connected in series with a main or appliance burner valve. Fuel to the valve or valves may come from a fuel supply via fuel line 37 to control mechanism or module 11. Main valve 21 may be connected to a pilot valve in control module 11 or the main valve may instead incorporate a pilot valve connected in series.

A probability of the pilot valve and the main or appliance burner valve being simultaneously stuck open may be low (e.g., six sigma) in that they are normally closed valves that need power to be opened and kept open. Thus, monitoring and diagnosis may be primarily directed to subject matter or an area other than a stuck valve.

A flue 22 may be an exhaust for a fuel fed burner or heater 12 in system 10. There may be a thermopile 14 connected by an electrical line 15 to mechanism 11. Pilot burner 16 may be connected via a fuel line 17 to a pilot valve in mechanism 11. There may be a spark rod 18, for igniting pilot burner or device 16, connected via an electrical line 19 to mechanism 11. A water temperature sensor 23 may be connected to mechanism 11 and situated in a water tank 24 for appliance burner 12. A temperature cut out limit detector in mechanism 11 may be connected to the water temperature sensor 23.

Figure 2:
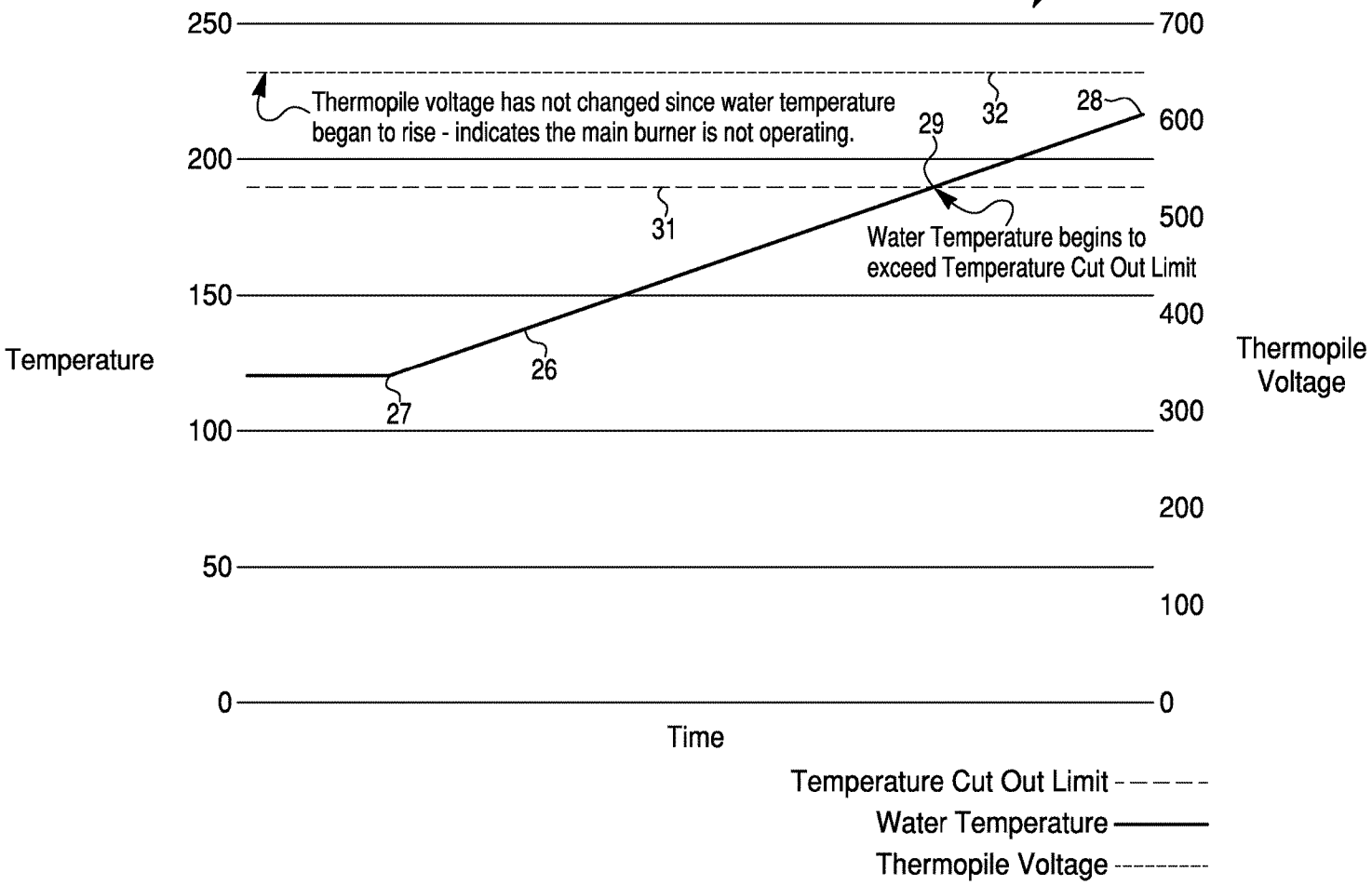
FIG. 2 is a diagram of a graph revealing water temperature and thermopile voltage versus time where the voltage does not change.

FIG. 2 is a graph 25 revealing temperature versus time, and voltage (e.g., millivolts) versus time. A water temperature 26 in the water heater tank 24 may be indicated by a line. From point 27 to point 28, the water temperature 26 is shown as increasing from about 120 to 215 degrees F. At point 29, the water temperature 26 begins to exceed a temperature cut out (TCO) limit 31 which is at about, for example, 190 degrees F. An additional X amount of temperature, for example, 15 degrees F., may be added to the TCO limit 31, for a larger limit, which if exceeded, could call for another kind of response than that for the TCO limit 31. The units and values of temperatures are illustrative examples and could be other units and values.

A line indicates a voltage 32 of thermopile 14. A thermopile voltage 32 of about 650 units is shown having not changed during a rise in water temperature 26. The lack of thermopile voltage 32 change and the use of water temperature 26 may indicate that appliance burner 12 is not operating.

Figure 3:
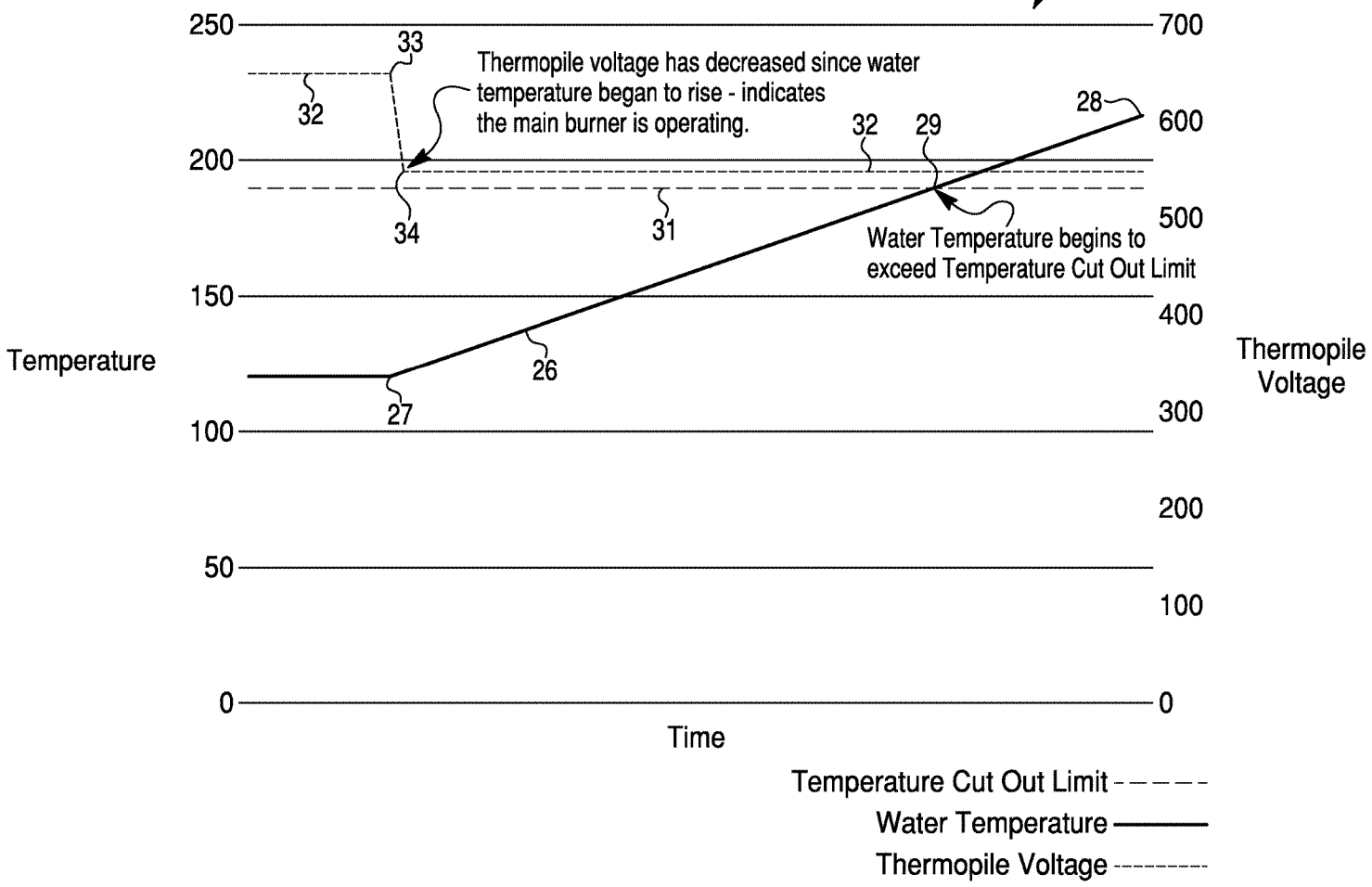
FIG. 3 is a diagram of a graph revealing water temperature and thermopile voltage versus time where the voltage changes.

FIG. 3 is a graph 35 revealing water temperature 26 and thermopile voltage 32. Water temperature 26 is shown with the same characteristics of temperature rise in graph 25 of FIG. 3. However, the characteristics of thermopile voltage 32 have changed in graph 35 relative to graph 25. About a time at point 27 where water temperature 26 is beginning to rise, thermopile voltage 32 began to decrease or drop at about point 33 from about 650 units of voltage at a fairly sudden rate to about point 34 and continued from there at the same level of 550 units of voltage even during a continual rise of water temperature 26. The decrease of thermopile voltage since water temperature 26 began to rise at point 27, may indicate that appliance burner 12 is operating. A duration of the whole decrease of thermopile voltage 32 may be less than five percent of the duration of the increase of water temperature 26 from point 27 to exceed the temperature cut out limit 31 at point 29. These durations of decrease and increase may vary in terms in magnitudes in time and comparative ratios of time relative to each other. The units of voltages are illustrative examples and could be other values. The ratios are likewise illustrative.

Figure 4:
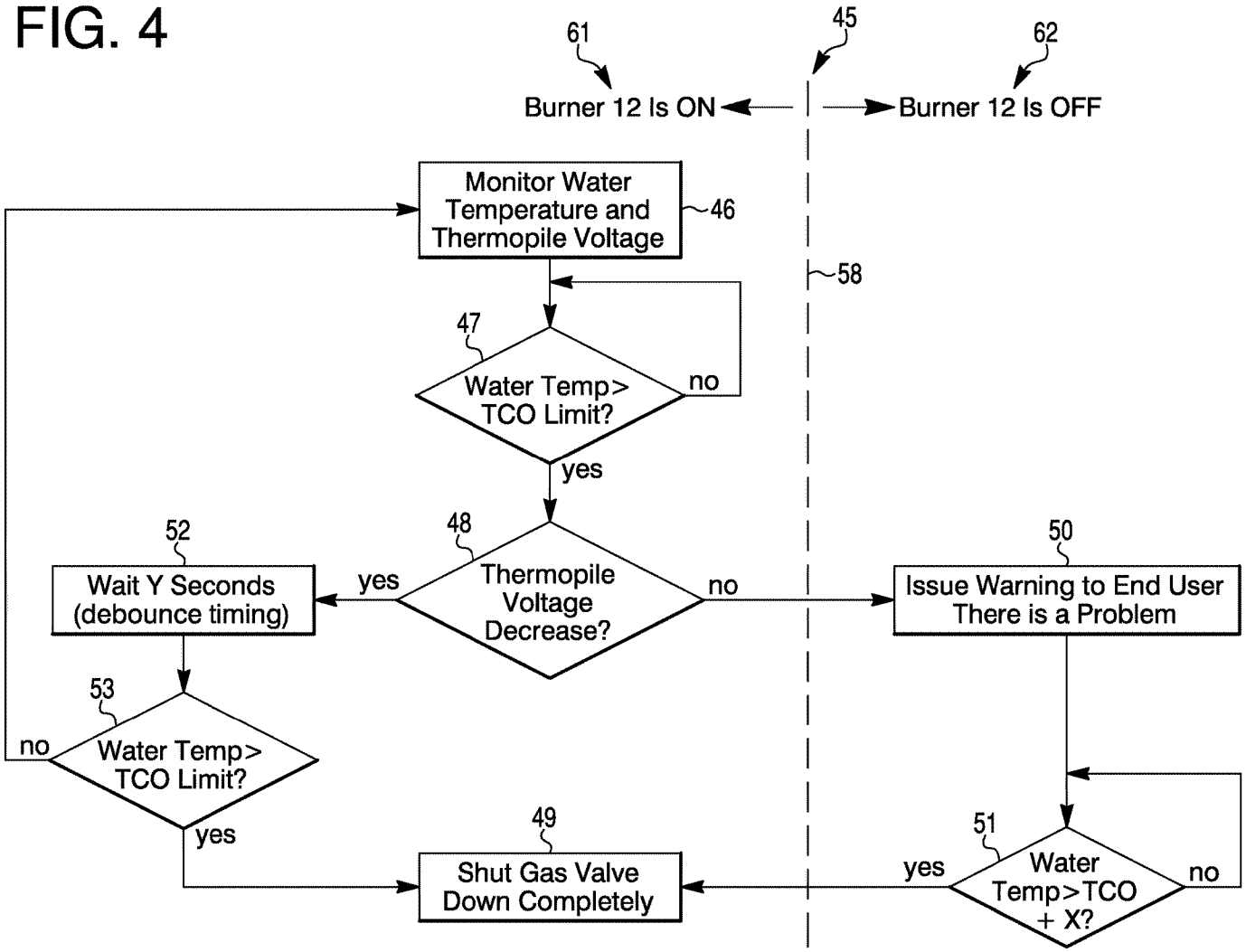
FIG. 4 is a flow diagram of the present approach for monitoring water temperature and appliance burner operation for detecting water heater system issues.

FIG. 4 is a flow diagram 45. Diagram 45 may be split by a dashed line 58 into a left portion 61 where the appliance burner 12 is on, and a right portion 62 where the appliance burner is regarded as off in the water heater system 10. At symbol 46, water temperature 26 and thermopile voltage 32 may be monitored. At a symbol 47 after symbol 46, a question is whether water temperature 26 is greater than the temperature cut out limit. If an answer is no, then the question may be asked again until the answer is yes. If no yes answer is obtained or achieved at the question of symbol 47, then the inquiry may cease or continue as desired.

In an event that the answer to the question of symbol 47 is yes, then at symbol 48, a question of whether thermopile voltage 32 decreased during a rise of water temperature 26 towards the TCO limit 31. If an answer is yes, then there may be a wait of Y seconds (i.e., debounce timing) at symbol 52, followed by a question at symbol 53 of whether water temperature 26 is greater than the TCO limit 31. If an answer to the question at symbol 53 is yes, then the gas valve on fuel line 13 may be shut down completely as indicated at symbol 49. If the answer to the question at symbol 53 is no, then a return to symbol 46 may be made to monitor water temperature 26 and thermopile voltage 32.

If the answer to the question 48 is no, then a warning may be provided to an end user or responsible maintenance representative revealing that there is a problem as indicated at symbol 50. Upon an indication at symbol 50, a question of whether water temperature 26 is greater than the TCO limit 31 plus X may be asked at a symbol 51. X may be a predetermined delta of temperature reflecting a design of the water heater or a desired severity of a warning. Adding an X value to the TCO may be in lieu of changing a set point (e.g., lowering it) of water temperature 26. If an answer to the question is no, then the question may be asked again until the answer is yes. If no yes answer is obtained or achieved at the question of symbol 51, then the inquiry may cease or continue as desired. If the answer to the question of symbol 51 indicates that the water temperature exceeds the temperature cut out limit plus an additional X value of temperature, then the valve on fuel line 13 to main appliance burner 12 may be shut down.

To recap, a valve status detection system may incorporate a water tank, an appliance burner at the water tank, a fuel valve connected to a fuel source and to the appliance burner via a fuel line, a valve actuator connected to the fuel valve, a pilot flame device at the appliance burner, a thermopile having a tip at the pilot flame device and having a base, a water temperature sensor at the water tank, and a control module connected to the valve actuator, the thermopile, and the water temperature sensor.

The control module may monitor the water temperature indicated by the water temperature sensor, and a voltage from the thermopile. The voltage from the thermopile have a first magnitude when the pilot flame device is heating the tip of the thermopile and the appliance burner is off. The voltage from the thermopile may have a second magnitude when the appliance burner is on and heating the base of the thermopile, and the pilot flame device is heating the tip of the thermopile.

If the voltage from the thermopile has the second magnitude and the water temperature exceeds a predetermined thermal cut off limit, then a warning indication may be provided by the control module and the control module may close the fuel valve.

If after the signal to the valve actuator is sent and the voltage from the thermopile has the first magnitude and the water temperature is greater than the predetermined thermal cut off limit, then a warning signal may be sent indicating that a problem exists with the water heater. If the voltage from the thermopile has the first magnitude and the water temperature is greater than the predetermined thermal cut off limit plus a predetermined temperature added to the cut off limit, then the control module may send a signal to the valve actuator to close the fuel valve.

If the voltage from the thermopile has the first magnitude and the water temperature is not greater than the predetermined thermal cut out limit, then the control module does not necessarily send a signal to the valve actuator to close the fuel valve.

An approach for determining a status of a water heater system, may incorporate monitoring water temperature of a water heater that is heated by an appliance burner having an associated pilot device, monitoring a magnitude of a voltage output by a thermopile having a first end heated by the pilot device and a second end heated when the appliance burner is operating, and checking whether the water temperature exceeds a thermal cut out limit.

A fuel valve may control fuel to the appliance burner. The magnitude of the voltage output by the thermopile may indicate a difference of temperatures at the first and second ends. If the water temperature exceeds the thermal cut out limit, then there may be a monitoring for a change of the magnitude of the voltage output by the thermopile. If there is a decrease of the magnitude of the voltage output by the thermopile during an increase of the water temperature, then the appliance burner may be operating and the fuel valve may be closed to shut down the appliance burner. If there is a decrease of the magnitude of the voltage output by the thermopile during an increase of the water temperature and the fuel valve is closed, then there may be another source of heat affecting the water temperature and the base of the pilot device.

If there is no decrease of the magnitude of the voltage output by the thermopile during an increase of the water temperature, indicating that the appliance burner is not operating, then a warning may be issued concerning the increase of the water temperature.

The approach may further incorporate determining whether the water temperature is greater than the thermal cut out limit by an amount of X degrees F. X may be a predetermined number indicating that the water temperature cannot increase beyond the thermal cut out limit by an amount of X degrees without the appliance burner operating.

If the water temperature is greater than the thermal cut out limit by the amount of X, then the fuel valve may be closed.

If the water temperature continues to be greater than the thermal cut out limit by the amount of X with the fuel valve signaled to be closed, then a warning may be issued indicating that that there is another cause of the water temperature continuing to be greater than the thermal cut out limit including the amount of X, instead of the appliance burner.

If the water temperature is equal to or less than the thermal cut out limit by an amount of X, then the water temperature may be continually monitored to watch for an event when the water temperature is greater than the thermal cut out limit including the amount of X.

If the water temperature is equal to or less than the thermal cut out limit, then the monitoring of the water temperature may continue.

A water heater system may incorporate an appliance burner configured to heat water in a tank of a water heater, a water temperature sensor configured to detect a water temperature in the tank, a pilot device configured to ignite the appliance burner, and a thermopile having a tip and a base, and having an output voltage that represents a temperature difference between the tip and the base.

The tip of the thermopile may be heated by the pilot device. The base of the thermopile may be heated by the appliance burner when the appliance burner is on. The voltage output of the thermopile may be less, when the appliance burner is on, than the voltage output of the thermopile when the appliance burner is not on.

If the water temperature of the water in the tank indicated by the water temperature sensor exceeds a thermal cut out limit, then whether the appliance burner is on or off may be determined according to the output voltage of the thermopile before a decision whether to disable the appliance burner is made.

If the appliance burner is determined to be off based on the voltage output of the thermopile, and the water temperature of the water in the tank, as indicated by the water temperature sensor, exceeds a thermal cut out limit, then a warning may be provided indicating that there appears to be an issue with the water heater.

An issue to determine may be whether sediment in the water tank is a cause of the water temperature in the tank indicated by the water temperature sensor to exceed a thermal cut out limit while the appliance burner is determined to be off based on the voltage output of the thermopile.

If the appliance burner is determined to be on based on the voltage output of the thermopile, and the water temperature of the water in the tank indicated by the water temperature sensor exceeds a thermal cut out limit temperature, then the appliance burner may be disabled.

If the appliance burner is operated with fuel from a fuel supply via a control valve, then the control valve may be closed to disable the appliance burner. If the appliance burner is indicated as not disabled according to the voltage output of the thermopile, then the control valve may be still at least partially open.

The system may further incorporate a control valve, and a control module connected to the water temperature sensor, the thermopile and the control valve.

If the appliance burner is operated with fuel from a fuel supply via the control valve, the control valve is directed by the control module of the water heater system to disable the appliance burner, the appliance burner is determined to be on based on the voltage output of the thermopile, and the water temperature of the water in the tank indicated by the water temperature sensor continues to exceed a thermal cut out limit, then the control valve may be determined to be at least partially open.

The system may further incorporate a control valve for fuel to the appliance burner, and a control module connected to the water temperature sensor, the thermopile and the control valve.

The control module may monitor a water temperature output from the water temperature sensor and monitor the voltage generated by the thermopile. If the water temperature rises and exceeds a thermal cut out limit, then the control monitor may check the voltage generated by the thermopile. If the voltage generated by the thermopile decreases compared to a voltage generated during a time when only the pilot device is heating the tip of the thermopile, then that the valve is turned on may be indicated and the control module may turn off the gas valve.

The system may further incorporate a control valve for fuel to the appliance burner, and a control module connected to the water temperature sensor, the thermopile and the control valve.

The control module may monitor a water temperature output from the water temperature sensor and monitor the voltage generated by the thermopile. If the water temperature rises and exceeds the thermal cut out limit and the voltage generated by the thermopile is not less than the voltage generated by the thermopile when only the pilot device is heating the tip of the thermopile, then the control module does not necessarily turn off the control valve and the control module may lower a set point of the water temperature and enunciate a need for service of the water heater.

U.S. patent application Ser. No. 13/604,469, filed Sep. 5, 2012, is hereby incorporated by reference. U.S. patent application Ser. No. 14/964,392; filed Dec. 9, 2015, is hereby incorporated by reference.

Any publication or patent document noted herein is hereby incorporated by reference to the same extent as if each publication or patent document was specifically and individually indicated to be incorporated by reference.

In the present specification, some of the matter may be of a hypothetical or prophetic nature although stated in another manner or tense.

Although the present system and/or approach has been described with respect to at least one illustrative example, many variations and modifications will become apparent to those skilled in the art upon reading the specification. It is therefore the intention that the appended claims be interpreted as broadly as possible in view of the related art to include all such variations and modifications.

What is claimed is:

1. A valve status detection system comprising:

a water tank;

an appliance burner at the water tank;

a fuel valve connected to a fuel source and to the appliance burner via a fuel line, the fuel valve controls fuel to the appliance burner;

a pilot flame device at the appliance burner;

a thermopile having a first end configured to be heated by the pilot flame device, and having a second end configured to be heated when the appliance burner is operating;

a water temperature sensor at the water tank; and a control module connected to the fuel valve, the thermopile, and the water temperature sensor; and wherein:

the voltage from the thermopile has a first magnitude when the pilot flame device is heating the first end of the thermopile and the appliance burner is off;

the voltage from the thermopile has a second magnitude when the appliance burner is on and heating the second end of the thermopile, and the pilot flame device is heating the first end of the thermopile;

the control module is configured to:

monitor a water temperature indicated by the water temperature sensor and a voltage from the thermopile;

monitor for a change of a magnitude of the voltage output by the thermopile when the monitored water temperature exceeds a thermal cut out limit;

determine the appliance burner is operating and close the fuel valve to shut down the appliance burner when there is a decrease in the magnitude of the voltage output by the thermopile during an increase of the water temperature; and determine there is another source of heat affecting the water temperature and the second end of the thermopile when there is a decrease in the magnitude of the voltage output by the thermopile during an increase of the water temperature while fuel valve is closed.

2. The system of claim 1, wherein the control module is configured such that when the monitored voltage from the thermopile has the second magnitude and the monitored water temperature exceeds a predetermined thermal cut off limit, a warning indication is provided by the control module.

3. The system of claim 1, wherein the controller is configured such that when the monitored voltage from the thermopile has the first magnitude and the water temperature is greater than the predetermined thermal cut off limit plus a predetermined temperature added to the cut off limit, then the control module sends a signal to the fuel valve to close the fuel valve.

4. The system of claim 1, wherein the control module is configured such that when the voltage from the thermopile has the first magnitude and the water temperature is not greater than the predetermined thermal cut out limit, then the control module does not send a signal to the fuel valve to close the fuel valve.

5. A method for determining a status of a water heater system, comprising:

monitoring water temperature of a water heater that is heated by an appliance burner having an associated pilot device;

monitoring a magnitude of a voltage output by a thermopile having a first end heated by the pilot device and a second end heated when the appliance burner is operating; and checking whether the water temperature exceeds a thermal cut out limit; and wherein:

a fuel valve controls fuel to the appliance burner;

the magnitude of the voltage output by the thermopile indicates a difference of temperatures at the first and second ends;

if the water temperature exceeds the thermal cut out limit, then a monitoring is made for a change of the magnitude of the voltage output by the thermopile;

if there is a decrease of the magnitude of the voltage output by the thermopile during an increase of the water temperature, then the appliance burner is operating and the fuel valve is closed to shut down the appliance burner; and if there is a decrease of the magnitude of the voltage output by the thermopile during an increase of the water temperature and the fuel valve is closed, then there is another source of heat affecting the water temperature and the second end of the pilot device.

6. The method of claim 5, wherein if there is no decrease of the magnitude of the voltage output by the thermopile during an increase of the water temperature, indicating that the appliance burner is not operating, then a warning is issued concerning the increase of the water temperature.

7. The method of claim 6, further comprising:

determining whether the water temperature is greater than the thermal cut out limit by an amount of X degrees F.; and wherein X is a predetermined number indicating that the water temperature cannot increase beyond the thermal cut out limit by an amount of X degrees without the appliance burner operating.

8. The method of claim 7, wherein if the water temperature is greater than the thermal cut out limit by the amount of X, then the fuel valve is closed.

9. The method of claim 8, wherein if the water temperature continues to be greater than the thermal cut out limit by the amount of X with the fuel valve signaled to be closed, then a warning is issued indicating that that there is another cause of the water temperature continuing to be greater than the thermal cut out limit including the amount of X, instead of the appliance burner.

10. The method of claim 8, if the water temperature is equal to or less than the thermal cut out limit by an amount of X, then the water temperature is continually monitored to watch for an event when the water temperature is greater than the thermal cut out limit including the amount of X.

11. The method of claim 10, wherein if the water temperature is equal to or less than the thermal cut out limit, then the monitoring of the water temperature continues.

12. A water heater system comprising:

an appliance burner configured to heat water in a tank of a water heater;

a water temperature sensor configured to detect a water temperature in the tank;

a pilot device configured to ignite the appliance burner;

a thermopile having a first end and a second end, and having an output voltage that represents a temperature difference between the first end and the second end;

a control module connected to the appliance burner, the water temperature sensor, the pilot device, and the thermopile; and wherein:

the first end of the thermopile is heated by the pilot device;

the second end of the thermopile is heated by the appliance burner when the appliance burner is on;

the voltage output of the thermopile is less, when the appliance burner is on, than the voltage output of the thermopile when the appliance burner is not on;

the control module is configured to:

monitor a water temperature indicated by the water temperature sensor and a voltage from the thermopile;

monitor for a change of a magnitude of the voltage output by the thermopile when the monitored water temperature exceeds a thermal cut out limit;

determine the appliance burner is operating and shut down the appliance burner when there is a decrease in the magnitude of the voltage output by the thermopile during an increase of the water temperature; and determine there is another source of heat affecting the water temperature and the second end of the thermopile when there is a decrease in the magnitude of the voltage output by the thermopile during an increase of the water temperature while fuel valve is closed.

13. The system of claim 12, wherein the control module is configured such that if the water temperature of the water in the tank indicated by the water temperature sensor exceeds the thermal cut out limit, then the control module determines whether the appliance burner is on or off according to the output voltage of the thermopile before a decision whether to disable the appliance burner is made.

14. The system of claim 13, wherein the control module is configured such that if the control module determines the appliance burner is off based on the monitored voltage output of the thermopile and determines the monitored water temperature of the water in the tank exceeds the thermal cut out limit, then the control module provides a warning indicating that there appears to be an issue with the water heater.

15. The system of claim 13, wherein the control module is configured such that if the control module determines the appliance burner is on based on the monitored voltage output of the thermopile and determines the monitored water temperature of the water in the tank exceeds a thermal cut out limit plus a predetermined amount of temperature, then the appliance burner is disabled.

16. The system of claim 15, further comprising:

a control valve in communication with the control module and configured to control fuel to the appliance burner;

wherein:

the control module is configured to close the control valve to disable the appliance burner.

17. The system of claim 12, further comprising:

a control valve for fuel to the appliance burner; and wherein the control module is configured to:

check the voltage generated by the thermopile when the water temperature rises and exceeds the thermal cut out limit; and indicate the control valve is turned on and turn off the control valve when the voltage generated by the thermopile decreases compared to a voltage generated during a time when only the pilot device is heating the first end of the thermopile.

18. The system of claim 12, further comprising:

a control valve for fuel to the appliance burner; and wherein:

the control module is configured to not turn off the control valve and to lower a set point of the water temperature and enunciate a need for service of the water heater when the water temperature rises and exceeds the thermal cut out limit and the voltage generated by the thermopile is not less than the voltage generated by the thermopile when only the pilot device is heating the first end of the thermopile.

* * * * *